US009587320B2

(12) United States Patent
Aoki et al.

(10) Patent No.: US 9,587,320 B2
(45) Date of Patent: Mar. 7, 2017

(54) ADDITIVE FOR ACID ZINC ALLOY PLATING BATH, ACID ZINC ALLOY PLATING BATH, AND METHOD FOR PRODUCING ZINC ALLOY PLATED ARTICLE

(71) Applicant: YUKEN INDUSTRY CO., LTD., Aichi (JP)

(72) Inventors: Yasunori Aoki, Aichi (JP); Takahiro Teramoto, Aichi (JP)

(73) Assignee: YUKEN INDUSTRY CO., LTD., Aichi (JP)

( * ) Notice: Subject to any disclaimer, the term of this patent is extended or adjusted under 35 U.S.C. 154(b) by 0 days.

(21) Appl. No.: 14/855,037

(22) Filed: Sep. 15, 2015

(65) Prior Publication Data

US 2016/0090659 A1 Mar. 31, 2016

(30) Foreign Application Priority Data

Sep. 25, 2014 (JP) ..... 2014-195859

(51) Int. Cl.
*C25D 3/56* (2006.01)
*C25D 3/22* (2006.01)

(52) U.S. Cl.
CPC ..... *C25D 3/565* (2013.01); *C25D 3/22* (2013.01)

(58) Field of Classification Search
CPC ..... C25D 3/22; C25D 3/565
USPC ..... 205/244
See application file for complete search history.

(56) References Cited

U.S. PATENT DOCUMENTS

| | | | | |
|---|---|---|---|---|
| 3,787,297 A * | 1/1974 | Beckwith | C25D 3/22 205/310 |
| 2016/0068984 A1 * | 3/2016 | Omachi | C25D 3/565 205/246 |

FOREIGN PATENT DOCUMENTS

| | | | |
|---|---|---|---|
| JP | 01-298192 | A | 12/1989 |
| JP | 2001-107289 | A | 4/2001 |
| JP | 4307810 | B2 | 5/2009 |
| JP | 2011-174100 | A | 9/2011 |
| JP | 2014-037621 | A | 2/2014 |
| JP | 2014-88608 | A | 5/2014 |
| JP | 2014-095147 | A | 5/2014 |
| JP | 2014-189850 | | 10/2014 |

* cited by examiner

*Primary Examiner* — Bryan D. Ripa
(74) *Attorney, Agent, or Firm* — Nakamishi IP Associates, LLC

(57) ABSTRACT

An additive for an acid zinc alloy plating bath includes an aliphatic polyamine having not more than 12 carbon atoms. The acid zinc alloy plating bath includes a buffer including an acetic acid-containing material containing acetic acid and/or acetate ions. A method for producing a zinc alloy plated article including an article and a zinc alloy plated coating formed on a plating surface of the article includes forming the zinc alloy plated coating by electroplating using the acid zinc alloy plating bath.

10 Claims, 2 Drawing Sheets

ADDITIVE FOR ACID ZINC ALLOY PLATING BATH, ACID ZINC ALLOY PLATING BATH, AND METHOD FOR PRODUCING ZINC ALLOY PLATED ARTICLE

BACKGROUND OF INVENTION

Field of the Invention

The present invention relates to an additive for an acid zinc alloy plating bath, an acid zinc alloy plating bath, and a method for producing a zinc alloy plated article.

Zinc alloy plating herein refers to plating made of zinc and alloy elements, and unavoidable impurities. Such zinc alloy plating may have a content of zinc (% by mass) higher than the content of every other alloy element (% by mass) in the plating, or may have a content of an alloy element higher than the zinc content (% by mass).

Background Art

The plated coatings of zinc alloys, such as a zinc-nickel alloy, a zinc-iron alloy, and a tin-zinc alloy (herein also referred to as "zinc alloy plated coatings"), are widely used for items around us, including machine parts made of steel, such as steel plates, bolts, and nuts for automobiles, to improve their resistance to corrosion, heat, and salt water.

A zinc alloy plated coating is formed by electroplating, or electrolysis performed in a plating bath intended for forming a zinc alloy plated coating (herein also referred to as a "zinc alloy plating bath"), in which a workpiece (an article to be plated) is immersed. Such zinc alloy plating baths can roughly be either alkaline baths (e.g., Japanese Unexamined Patent Application Publication No. 1-298192) or acidic baths (e.g., Japanese Patent No. 4307810). Alkaline baths include cyanide baths and zincate baths, whereas acidic baths include zinc chloride baths and zinc sulfate baths. A bath is selected from such zinc alloy plating baths to suit various conditions including the hardness and the brightness of an intended zinc alloy plated coating, the shape and the size of an article to be plated, and the operating environment.

Among these zinc alloy plating baths, acid zinc alloy plating baths have high current efficiency and thus have high productivity. However, an article plated using an acid zinc alloy plating bath can have its coating thickness or its appearance highly dependent on the current density. An article with a complicated shape can easily have lower coverage or defective appearance.

SUMMARY OF INVENTION

One or more embodiments of the present invention provide an additive used for an acid zinc alloy plating bath to form a zinc alloy plated coating with good appearance.

Also, one or more embodiments of the present invention provide an acid zinc alloy plating bath that can form a zinc alloy plated coating with good appearance, and a method for producing a zinc alloy plated article using the acid zinc alloy plating bath.

A zinc alloy plated article herein refers to an article having its surface coated with zinc alloy plating. Further, a zinc alloy plated coating with "good appearance" herein refers to the coating that has one or both of the two characteristics: the lowest current density at which abnormal deposition of the coating occurs easily is higher than that for conventional coatings, and the coating is bright or semi-bright at a current density at which conventional coatings would have been dull.

In response to the above issue, the present invention has the following aspects.

(1) An additive for an acid zinc alloy plating bath includes an aliphatic polyamine having not more than 12 carbon atoms. In one or more embodiments of the present invention, the additive further includes a buffer. The buffer may include an acetic acid-containing material that contains acetic acid and/or acetate ions at a concentration of not less than 10 g/L expressed as a content of acetic acid, and a boric acid-containing material that contains boric acid and/or boric acid ions at a concentration of not more than 0.1 g/L expressed as a content of boric acid. Also, in one or more embodiments of the present invention, the buffer includes no ammonia-containing material that contains ammonia and/or ammonium ions.

(2) In the additive according to aspect (1), the aliphatic polyamine includes at least one compound selected from the group consisting of ethylenediamine, diethylenetriamine, triethylenetetramine, and tetraethylenepentamine.

(3) In the additive according to aspect (1), the aliphatic polyamine includes none of a carbonyl group and a group including a carbonyl group.

(4) An acid zinc alloy plating bath includes the additive according to any one of aspects (1) to (3).

(5) In the acid zinc alloy plating bath according to aspect (4), the content of the aliphatic polyamine is in a range of 0.1 to 30 g/L inclusive.

(6) The acid zinc alloy plating bath according to any one of aspects (4) and (5) further includes an acetic acid-containing material containing acetic acid and/or acetate ions.

(7) An acid zinc alloy plating bath includes a buffer. The buffer may include an acetic acid-containing material that contains acetic acid and/or acetate ions at a concentration of not less than 10 g/L expressed as a content of acetic acid, and a boric acid-containing material that contains boric acid and/or boric acid ions at a concentration of not more than 0.1 g/L expressed as a content of boric acid. Also, the buffer may include no ammonia-containing material that contains ammonia and/or ammonium ions.

(8) The acid zinc alloy plating bath according to aspect (7) further includes the additive according to any one of aspects (1) to (3).

(9) In the acid zinc alloy plating bath according to aspect (8), the content of the aliphatic polyamine is in a range of 0.1 to 30 g/L inclusive.

(10) The acid zinc alloy plating bath according to any one of aspects (4) to (9) further includes at least one member selected from the group consisting of primary brighteners and secondary brighteners.

(11) A method for producing a zinc alloy plated article including an article and a zinc alloy plated coating formed on a plating surface of the article includes forming the zinc alloy plated coating by electroplating using the acid zinc alloy plating bath according to any one of aspects (4) to (10).

(12) In the method according to aspect (11), in the electroplating, the article has a current density in a range of 0.1 to 10 A/dm$^2$ inclusive.

(13) In the method according to any one of aspects (11) and (12), the article is a secondary processed article.

An acid zinc alloy plating bath containing an additive according to one or more embodiments of the present invention allows formation of a zinc alloy plated coating with good appearance. One or more embodiments of the present invention also allow production of an article having a zinc alloy plated coating with good appearance.

DETAILED DESCRIPTION

Figure 1:
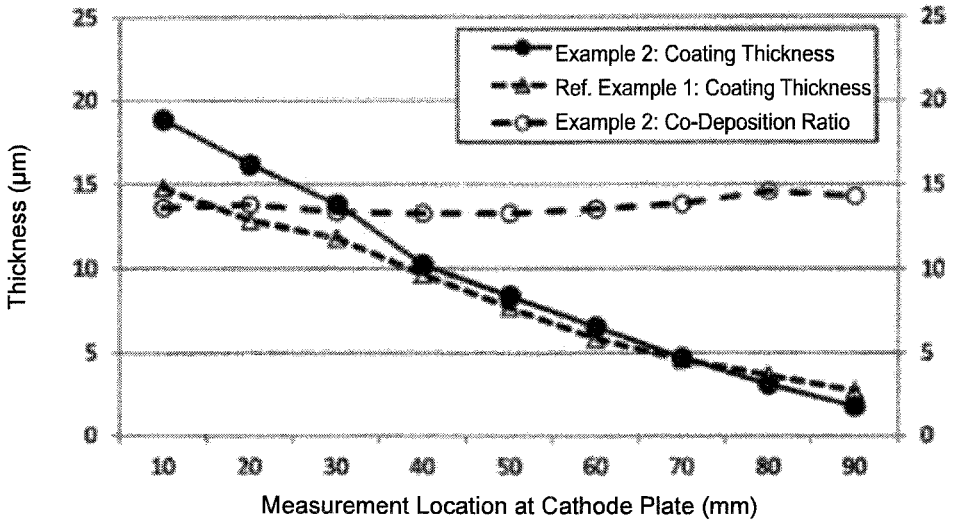
FIG. 1 is a graph showing the results obtained in example 2.

One or more embodiments of the present invention will now be described in detail.

1. Additive for Acid Zinc Alloy Plating Bath

An additive for an acid zinc alloy plating bath according to one embodiment of the present invention contains an aliphatic polyamine having a plurality of amino groups and having not more than 12 carbon atoms (herein also referred to as polyamine (A)). Such an acid zinc alloy plating bath containing polyamine (A) allows easy formation of a zinc alloy plated coating with bright appearance. Further, a zinc alloy plated coating obtained by electroplating performed in this plating bath with a high current density is less likely to have abnormal deposition. Polyamine (A) functions as a primary brightener. The use of polyamine (A) thus reduces the content of a surfactant that is commonly used as a primary brightener. The lower content of the surfactant in the plating bath reduces the foaming problems, which can degrade the workability of the zinc alloy plating.

The use of polyamine (A) in a zinc-nickel alloy plating bath allows easier formation of a zinc-nickel alloy plated coating with a nickel co-deposition ratio in a range of 10 to 20 mass % inclusive in some embodiments, in a range of 12 to 18 mass % inclusive in some other embodiments, and in a range of 14 to 16 mass % inclusive in still other embodiments.

Polyamine (A) is an aliphatic compound having any composition when this compound has not more than 12 carbon atoms and has a plurality of amino groups. Polyamine (A) may be any of primary amines, secondary amines, and tertiary amines.

Examples of primary amines that can serve as polyamine (A) include ethylenediamine, 1,2-diaminopropane, 1,3-diaminopropane, 1,2-diaminobutane, 1,3-diaminobutane, 1,4-diaminobutane, 1,5-diaminopentane, 1,6-diaminohexane, 1,7-diaminoheptane, 1,8-diaminooctane, dimethylaminopropylamine, diethylaminopropylamine, bis-(3-aminopropyl)ether, 1,2-bis-(3-aminopropoxy)ethane, 1,3-bis-(3-aminopropoxy)-2,2'-dimethylpropane, aminoethylethanolamine, 1,2-bis(amino)cyclohexane, 1,3-bis(amino)cyclohexane, 1,4-bis(amino)cyclohexane, 1,3-bis(aminomethyl)cyclohexane, 1,4-bis(aminomethyl)cyclohexane, 1,3-bis(aminoethyl)cyclohexane, 1,4-bis(aminoethyl)cyclohexane, 1,3-bis(aminopropyl)cyclohexane, 1,4-bis(aminopropyl)cyclohexane, hydrogenated 4,4'-diaminodiphenylmethane, 2-aminopiperidine, 4-aminopiperidine, 2-(aminomethyl)piperidine, 4-(aminomethyl)piperidine, 2-(aminoethyl)piperidine, 4-(aminoethyl)piperidine, N-(aminoethyl)piperidine, N-(aminopropyl)piperidine, N-(aminoethyl)morpholine, N-(aminopropyl)morpholine, isophoronediamine, menthanediamine, 1,4-bis(aminopropyl)piperazine, diethylenetriamine, iminobispropylamine, methyliminobispropylamine, bis(hexamethylene)triamine, triethylenetetramine, tetraethylenepentamine, pentaethylenehexamine, N-aminoethylpiperazine, N-aminopropylpiperazine, 1,4-bis(aminoethylpiperazine), and 1,4-bis(aminopropylpiperazine).

Examples of secondary amines that can serve as polyamine (A) include N,N'-dimethylethylenediamine, N,N'-dimethyl-1,2-diaminopropane, N,N'-dimethyl-1,3-diaminopropane, N,N'-dimethyl-1,2-diaminobutane, N,N'-dimethyl-1,3-diaminobutane, N,N'-dimethyl-1,4-diaminobutane, N,N'-dimethyl-1,5-diaminopentane, N,N'-dimethyl-1,6-diaminohexane, N,N'-dimethyl-1,7-diaminoheptane, N,N'-diethylethylenediamine, N,N'-diethyl-1,2-diaminopropane, N,N'-diethyl-1,3-diaminopropane, N,N'-diethyl-1,2-diaminobutane, N,N'-diethyl-1,3-diaminobutane, N,N'-diethyl-1,4-diaminobutane, and N,N'-diethyl-1,6-diaminohexane.

Examples of tertiary amines that can serve as polyamine (A) include tetramethylethylenediamine, N,N'-dimethylpiperazine, N,N'-bis((2-hydroxy)propyl)piperazine, hexamethylenetetramine, N,N,N',N'-tetramethyl-1,3-butaneamine, 2-dimethylamino-2-hydroxypropane, diethyl amino ethanol, N,N,N-tris(3-dimethylaminopropyl)amine, 2,4,6-tris(N,N-dimethylaminomethyl)phenol, and heptamethylisobiguanide.

Polyamine (A) may include at least two amino groups selected from the group consisting of a primary amino group, a secondary amino group, and a tertiary amino group. Examples of such compounds include ethylenediamine, diethylenetriamine, triethylenetetramine, tetraethylenepentamine, and biguanide.

Polyamine (A) may be a single compound or may include a plurality of compounds. Polyamine (A) may contain a plurality of compounds at any ratio of their contents set in accordance with intended properties.

Polyamine (A) has mot more than 10 carbon atoms in some embodiments, has not more than 8 carbon atoms in some other embodiments, and has not more than 6 carbon atoms in still other embodiments.

Examples of such polyamine (A) include ethylenediamine, diethylenetriamine, triethylenetetramine, and tetraethylenepentamine, among which ethylenediamine, diethylenetriamine, and/or triethylenetetramine serve as polyamine (A) in some embodiments.

Polyamine (A) may have none of a carbonyl group and a group containing a carbonyl group.

The additive according to the embodiment of the present invention may contain components other than polyamine (A). Such other components include a primary brightener, a secondary brightener, an antioxidant, an antifoamer, and a sequestrant. The additive according to the embodiment of the present invention contains polyamine (A) that functions as a primary brightener or a secondary brightener, and thus may not contain at least one of a primary brightener and a secondary brightener.

2. Acid Zinc Alloy Plating Bath

The zinc alloy plating bath according to the embodiment of the present invention is acidic, and has higher current efficiency and higher productivity than an alkaline zinc alloy plating bath. The zinc alloy plating bath according to the embodiment of the present invention contains polyamine (A) described above, and thus enables easy formation of a zinc alloy plated coating with good appearance.

(1) Metal Elements (1)-1 Bath Soluble Zinc-Containing Material

The zinc alloy plating bath according to the present embodiment contains a zinc-containing material that is soluble in the bath. A bath soluble zinc-containing material herein refers to a source of zinc that deposits to form a zinc alloy plated coating. The bath soluble zinc-containing material includes at least one element selected from the group consisting of positive ions of zinc and a bath soluble material containing positive zinc ions. The zinc alloy plating bath according to the present embodiment is acidic, and thus uses zinc ions ($Zn^{2+}$) as a bath soluble zinc-containing material.

Examples of the source material (herein also referred to as the zinc source) for supplying the bath soluble zinc-containing material to the plating bath include zinc chloride, zinc sulfate, and zinc oxide.

The zinc alloy plating bath according to the present embodiment may have any content of soluble zinc-containing material expressed in terms of zinc (the content of soluble zinc-containing material in the bath expressed in terms of zinc). When this content is too low, zinc is difficult to deposit to form a zinc alloy plated coating. Thus, the content of the zinc-containing material expressed in terms of zinc is not less than 5 g/L in some embodiments, is not less than 10 g/L in some other embodiments, and is not less than 15 g/L in still other embodiments. When the content of the soluble zinc-containing material expressed in terms of zinc is too high, the coating may easily have lower coverage or defective appearance. The content of the zinc-coating material expressed in terms of zinc is not more than 100 g/L in some embodiments, is not more than 80 g/L in some other embodiments, and is not more than 60 g/L in still other embodiments.

(1)-2 Bath Soluble Metal-Containing Material

The zinc alloy plating bath according to the embodiment of the present invention contains a metal-containing material that is soluble in the bath. The bath soluble metal-containing material herein refers to a source of metal other than zinc contained in the zinc alloy plated coating. The bath soluble metal-containing material contains at least one element selected from the group consisting of positive ions of metals and bath soluble materials containing positive metal ions. Examples of metal elements contained in the bath soluble metal-containing material include iron, nickel, and tin. In some embodiments, the metal-containing material contains a metal element selected from the group consisting of iron, nickel, and tin.

The source material (herein also referred to as the metal source) for supplying the bath soluble metal-containing material to the plating bath may be selected in accordance with the metal element contained in the bath soluble metal-containing material. When, for example, the bath soluble metal-containing material contains iron as a metal element, or in other words when the zinc alloy plating bath contains a bath soluble iron-containing material, the iron source may be $Fe_2(SO_4)_3.7H_2O$, $FeSO_4.7H_2O$, $Fe(OH)_3$, $FeCl_3.6H_2O$, or $FeCl_2.4H_2O$. When the bath soluble metal-containing material contains nickel as a metal element, or in other words when the zinc alloy plating bath contains a bath soluble nickel-containing material, the nickel source may be $NiSO_4.6H_2O$, $NiCl_2.6H_2O$, or $Ni(OH)_2$. When the bath soluble metal-containing material contains tin as a metal element, or in other words when the zinc alloy plating bath contains a bath soluble tin-containing material, the tin source may be $SnSO_4$, $SnCl_2$, or $SnCl_2.2H_2O$.

The content of the soluble metal-containing material expressed in terms of metal in the zinc alloy plating bath according to the embodiment of the present invention is set in accordance with the composition of the intended zinc alloy plating. When the zinc alloy plating bath contains a bath soluble iron-containing material, the content of the soluble iron-containing material expressed in terms of iron is, for example, in a range of about 1 to 100 g/L inclusive. When the zinc alloy plating bath contains a bath soluble nickel-containing material, the content of the soluble nickel-containing material expressed in terms of nickel is, for example, in a range of about 0.1 to 60 g/L inclusive. In some embodiments, the content of the soluble nickel-containing material expressed in terms of nickel is in a range of about 80 to 120 g/L inclusive. When the zinc alloy plating bath contains a bath soluble tin-containing material, the content of the soluble tin-containing material expressed in terms of tin is, for example, in a range of about 1 to 100 g/L inclusive.

When the zinc alloy plating bath contains nickel as an alloy element, the zinc alloy plating bath in some embodiments intends to form a zinc-nickel alloy plated coating with a nickel co-deposition ratio of 10 to 20 mass % inclusive to particularly improve its corrosion resistance. A zinc-nickel alloy containing 15% by mass of nickel is highly resistant to corrosion. The zinc-nickel alloy plated coating having a nickel co-deposition ratio of 10 to 20 mass % inclusive has a high content of the alloy that is highly resistant to corrosion, and is thus expected to have high corrosion resistance. To improve the corrosion resistance of the zinc-nickel alloy plated coating, the nickel co-deposition ratio is 12 to 18 mass % inclusive in some embodiments, and is 13 to 16 mass % inclusive in some other embodiments. The nickel co-deposition ratio may also be less than 10 mass %, or may be, for example, about 8 mass %.

(2) Additive Components

The zinc alloy plating bath according to the embodiment of the present invention contains polyamine (A) as an additive component, and may also contain other additive components.

(2)-1 Polyamine (A)

The zinc alloy plating bath according to the embodiment of the present invention contains polyamine (A). The content of polyamine (A) is set in accordance with the type of polyamine (A), the type and the content of components other than polyamine (A) contained in the zinc alloy plating bath, as well as the composition of the zinc alloy plated coating formed by using the zinc alloy plating bath. The zinc alloy plating bath according to the embodiment of the present invention may have any content of polyamine (A). For example, the content of polyamine (A) falls within, but is not limited to, a range of 0.1 to 100 g/L inclusive. At the content of not less than 0.1 g/L, polyamine (A) in the bath easily produces its intended effect. At the content of not more than 100 g/L, polyamine (A) reduces the occurrence of insoluble matter in the bath.

Some zinc alloy plating baths can form a zinc alloy plated coating with good appearance in a more stable manner when the content of polyamine (A) in the bath is not more than a predetermined content. For example, a zinc-nickel alloy plating bath can form a zinc-nickel alloy plated coating with good appearance in a more stable manner when the content of polyamine (A) in the plating bath is not more than 30 g/L. In some embodiments, the content of polyamine (A) in the bath is not more than 20 g/L to form a zinc-nickel alloy plated coating with good appearance in a more stable manner.

(2)-2 Other Additive Components

The zinc alloy plating bath according to the embodiment of the present invention may contain additive components other than polyamine (A). Such other additive components or materials for supplying additive components in the zinc alloy plating bath will now be described.

(i) Primary Brightener

The zinc alloy plating bath according to the embodiment of the present invention may contain a primary brightener as an additive component. The primary brightener may be an anionic surfactant, a nonionic surfactant, or a water-soluble organic compound such as a water-soluble cationic high molecular compound, which is used for various zinc plating baths.

The primary brightener may contain both an anionic surfactant, such as a sulfonic group, and a nonionic surfactant, such as a polyether. Examples of such compounds include an alkali metal salt of an aromatic or aliphatic polyether sulfate ester.

In some embodiments, the zinc alloy plating bath contains a nitrogen-free surfactant as a primary brightener. The nitrogen-free surfactant is, for example, the above alkali metal salt of an aromatic or aliphatic polyether sulfate ether, or a polyether compound of an acetylenic dihydric alcohol.

The zinc alloy plating bath according to the embodiment of the present invention may have any content of primary brightener. The content of the primary brightener is set in accordance with the type of the primary brightener, the type and the content of components other than the primary brightener contained in the zinc alloy plating bath, as well as the composition of the zinc alloy plated coating formed by using the zinc alloy plating bath. For example, the content of the primary brightener is in a range of 0.1 to 100 g/L inclusive in some embodiments, and is in a range of 0.5 to 20 g/L inclusive in some other embodiments.

As described above, polyamine (A) functions as a primary brightener, and thus reduces the content of a surfactant that is used as a primary brightener. The lower content of the surfactant in the plating bath reduces the foaming problems, which can degrade the workability of the zinc alloy plating.

(ii) Secondary Brightener

The zinc alloy plating bath according to the embodiment of the present invention may contain a secondary brightener as an additive component. In particular, the secondary brightener may be an aromatic compound having a carbonyl group to improve brightness. Examples of such compounds include aromatic aldehydes, such as anisaldehyde, veratraldehyde, o-chlorobenzaldehyde (OCAD), salicylaldehyde, vanillin, piperonal, and p-hydroxybenzaldehyde, and acetones having aromatic rings, such as benzylideneacetone.

The zinc alloy plating bath according to the embodiment of the present invention may have any content of secondary brightener. The content of the secondary brightener is set in accordance with the type of the secondary brightener, the type and the content of components other than the secondary brightener contained in the zinc alloy plating bath, as well as the composition of the zinc alloy plated coating formed by using the zinc-based plating bath. For example, the content of the secondary brightener is in a range of 0.001 to 10 g/L inclusive in some embodiments, or is in a range of 0.005 to 1 g/L inclusive in some other embodiments.

(iii) Other Components

The zinc alloy plating bath according to the embodiment of the present invention may contain additive components other than the components described above. Examples of such other additive components include antioxidants, antifoamers, and sequestrants.

Examples of antioxidants include hydroxyphenyl compounds, such as phenol, catechol, resorcin, hydroquinone, and pyrogallol, L-ascorbic acid, and sorbitol.

Examples of antifoamers include silicone antifoamers, and organic antifoamers such as surfactants, polyether, and higher alcohols.

Examples of sequestrants include silicates (e.g., sodium silicates) and silica (e.g., colloidal silica). The zinc alloy plating bath may have any content of sequestrant. The content of the sequestrant is set in accordance with the type of the sequestrant and the solvent composition. For example, the content of the sequestrant is in a range of 0.1 to 100 g/L inclusive in some embodiments, and is in a range of 0.5 to 20 g/L inclusive in some other embodiments.

(3) Buffer and Inorganic Electrolyte

The zinc alloy plating bath according to the embodiment of the present invention may contain a material that functions as a buffer. The use of the buffer prevents the pH in the vicinity of the surface of a workpiece from becoming excessively high. As a result, the metal, such as zinc, deposits onto the workpiece in a stable manner, and abnormal deposition is less likely to occur.

The zinc alloy plating bath according to the embodiment of the present invention may contain any buffer. Examples of such buffers include an acetic acid-containing material containing acetic acid and/or acetate ions, an ammonia-containing material containing ammonia and/or ammonium ions, and a boric acid-containing material containing boric acid and/or boric acid ions. The zinc alloy plating bath intended for zinc alloy plating may contain an acetic acid-containing material as a buffer to stabilize the deposition of the zinc alloy plating. To stabilize the deposition, the zinc alloy plating contains nickel as an alloy element in some embodiments.

To reduce the environmental load, the content of the acetic acid-containing material in the zinc alloy plating bath, expressed in terms of acetic acid, is not more than 200 g/L in some embodiments, and is not more than 100 g/L in some other embodiments, and is not more than 50 g/L in still other embodiments. To allow the acetic acid-containing material to function as a buffer in a stable manner, the content of the acetic acid-containing material in the zinc alloy plating bath, expressed in terms of acetic acid, is not less than 1 g/L in some embodiments, is not less than 5 g/L in some other embodiments, and is not less than 10 g/L in still other embodiments.

To reduce the environmental load, the content of the ammonia-containing material in the zinc alloy plating bath, expressed in terms of ammonia, is not more than 100 g/L in some embodiments, is not more than 50 g/L in some other embodiments, and is not more than 10 g/L in still other embodiments. In some embodiments, the zinc alloy plating bath contains substantially no ammonia-containing material.

To reduce the environmental load, the content of the boric acid-containing material in the zinc alloy plating bath, expressed as the content of boric acid, is not more than 5 g/L in some embodiments, is not more than 1 g/L in some other embodiments, and is not more than 0.1 g/L in still other embodiments. In some embodiments, the zinc alloy plating bath contains substantially no boric acid-containing material.

The zinc alloy plating bath according to the embodiment of the present invention has a low content of ammonia-containing material or boric acid-containing material, and thus has a low load on the environment. The zinc alloy plating bath according to the embodiment of the present invention thus has its effluent easy to treat.

The zinc alloy plating bath according to the embodiment of the present invention may contain an inorganic electrolyte. Examples of such inorganic electrolytes include chloride ions, sulfate ions, nitrate ions, phosphate ions, sodium ions, potassium ions, magnesium ions, and aluminum ions. The zinc alloy plating bath may contain such ions in the form of a salt including cations and anions. The zinc alloy plating bath according to the embodiment of the present invention may contain any total content of such inorganic electrolytes. The total content of inorganic electrolytes is set in accordance with the type of the inorganic electrolytes, the type and the content of components other than the inorganic electrolytes contained in the zinc alloy plating bath, as well as the composition of the zinc alloy plated coating formed by using the zinc alloy plating bath, and the plating conditions. For example, the total content of inorganic electrolytes in the zinc alloy plating bath is in a range of 10 to 1000 g/L inclusive in some embodiments, and is in a range of 50 to 500 g/L inclusive in some other embodiments.

(4) Solvent and Liquidity

The solvent in the zinc alloy plating bath according to the embodiment of the present invention is mainly composed of water. In addition to water, the zinc alloy plating bath may additionally contain organic solvents that are highly soluble in water, such as alcohols, ethers, and ketones. To maintain the stability of the entire plating bath and reduce its load on the effluent treatment, such organic solvents may constitute not more than 10% by volume of all the solvents.

The zinc alloy plating bath according to the embodiment of the present invention is acidic, and its pH is in a range of 4.5 to 6.5 inclusive in some embodiments, and is in a range of 5.0 to 5.8 inclusive in some other embodiments. The pH of the plating bath can be adjusted by using any material known in the art, including hydrochloric acid, sulfuric acid, nitric acid, and an alkali metal hydroxide such as sodium hydroxide or potassium hydroxide.

(5) Preparation of Bath

The zinc alloy plating bath according to the present embodiment may be prepared with any method. A zinc plating bath serving as the zinc alloy plating bath of the present embodiment can be prepared by dissolving a zinc source and polyamine (A), as well as optional additional components including other additive components, a buffer, and an inorganic electrolyte, which are described above, into the solvent such as water. A zinc alloy plating bath serving as the zinc alloy plating bath of the present embodiment can be prepared by dissolving a zinc source, a metal source, and polyamine (A), as well as optional additional components including other additive components, a buffer, and an inorganic electrolyte, which are described above, into the solvent.

3. Method for Producing Zinc Alloy Plated Article

A zinc alloy plated article can be produced by placing an article to be plated in contact with the zinc alloy plating bath according to the present embodiment, and causing electrolysis that uses the article as a cathode (negative pole). The zinc alloy plating bath and the article may be placed into contact with each other with any method. Whereas a typical method to achieve this contact between the article and the zinc alloy plating bath is to place the article into the plating bath, the contact may be achieved by spraying the plating solution forming the zinc alloy plating bath onto the article.

The article to be plated may be formed from any conductive material. Examples of such conductive materials include metal materials such as iron materials, and conductive layers that can be prepared by electroless plating performed on the surface of a non-conductive material, such as a resin or ceramic material. The article may have any shape. Examples of articles that can be plated include primary processed articles, such as plates, rods, and wire rods, and secondary processed articles, such as articles that have undergo cutting or grounding (or further polishing), including screws, bolts, and molds, pressed articles including car body frames and device housings, and castings including brake calipers and engine blocks. A casting formed from an iron material can contain elements added to enhance castability, which can disable formation of a zinc alloy plated coating on this article using an alkaline zinc alloy plating bath.

The anode (positive pole) may be formed from any material. The anode may be a soluble anode formed from a metallic material containing zinc or an alloy element. An anode formed from a zinc material and an anode formed from a material containing an alloy element may be prepared separately. These anodes may be connected to different power supplies, and the voltages applied to the anodes may be controlled independently of each other.

The electrolysis may be performed at any current density. The current density is set as appropriate. An excessively low current density causes a low deposition rate of the resulting zinc alloy plated coating and thus causes low productivity, and an excessively high current density causes poor appearance of the resulting zinc plated coating or lower uniformity of electrodeposition and lower coverage. To achieve both high productivity and high quality of the plated coating, the current density is in a range of 0.1 to 10 $A/dm^2$ inclusive in some embodiments, and is in a range of 0.5 to 5 $A/dm^2$ inclusive in some other embodiments.

The temperature of the plating bath during electrolysis (plating bath temperature) may be in a range of about 15 to 50° C., or may be about room temperature (about 25° C.).

The electrolytic time (plating time) may be set in accordance with the deposition rate of the plated coating that is determined by the composition of the zinc alloy plating bath, the above current density, the plating bath temperature, and the thickness of the intended plated coating.

The plating equipment may have any structure. An article to be plated, which functions as a cathode, is placed in the zinc alloy plating bath in a manner to face an anode plate or rod in the bath, and then electrolysis is performed in the zinc alloy plating bath with the solution being agitated as appropriate. This forms a zinc alloy plated coating on the article. The agitation may be achieved with a liquid circulation pump or aeration, or by moving the article or the like in the plating bath.

Examples of other plating equipment include barrel plating equipment including a zinc alloy plating bath in which a barrel accommodating articles such as bolts is immersed. With the barrel being rotated, electrolysis is performed in the bath to form a zinc alloy plated coating on each article. Examples of articles that can be plated using the barrel plating equipment include bolts, nuts, and screws. For an article with high shape anisotropy (long and thin article), such as a bolt, the zinc alloy plating bath according to the embodiment of the present invention allows less variations in the appearance, the coating thickness, and the co-deposition ratio of the resultant zinc alloy plated coating between the distal ends and the other portions of the article. Unlike the alkaline zinc alloy plating bath having low current efficiency, a conventional acid zinc alloy plating bath having high current efficiency causes variations in the appearance, the coating thickness, and the co-deposition ratio between the distal ends and the other portions.

The embodiments have been described to facilitate understanding of the present invention but not to limit the invention. The elements described in the above embodiments are intended to encompass all modifications and equivalents that fall within the technical scope of the present invention.

For example, the zinc alloy plated coating of the zinc alloy plated article may undergo chemical conversion treatment.

EXAMPLES

Although the advantages of the present invention will now be described based on examples, this invention is not limited to the examples.

Example 1

Zinc alloy plating baths with the following composition and the pH of 5.4 were prepared.

Zinc chloride: 70 g/L (35 g/L in terms of zinc)

Nickel chloride hexahydrate: 80 g/L (20 g/L in terms of nickel)

Potassium chloride: 200 g/L

Acetic acid-containing material as a buffer: 40 g/L in terms of acetic acid

Aliphatic polyamine: 2 g/L of the compound shown in Table 1

Primary brightener: 30 ml/L

Secondary brightener: 2 ml/L

In the prepared plating baths, electrolysis was performed with the Hull cell tester B-55-L (YAMAMOTO-MS Co., Ltd.) under the conditions below:

Current: 2 A

Time: 10 min.

Solution temperature: 30° C.

Agitation: None

Anode plate: Nickel plate

Cathode plate: Iron plate (the surface to be plated has a horizontal width of 200 mm)

The appearance of the resultant cathode plate was observed. Table 1 shows the results. In the table, ASD denotes A/dm$^2$.

TABLE 1

| | Appearance of Cathode Plate after Plating | |
|---|---|---|
| | Range | Appearance |
| No Additive | Not less than 0.6 ASD | Abnormal deposition |
| | Less than 0.6 ASD | Dull |
| Ethylenediamine | Not less than 6.0 ASD | Abnormal deposition |
| | Less than 6.0 ASD and not less than 0.09 ASD | Bright |
| | Less than 0.09 ASD | Dull |
| Diethyl-enetriamine | Not less than 8.4 ASD | Abnormal deposition |
| | Less than 8.4 ASD | Bright |
| Triethyl-enetetramine | Not less than 8.4 ASD | Abnormal deposition |
| | Less than 8.4 ASD and not less than 0.07 ASD | Semi-bright |
| | Less than 0.07 ASD | Bright |
| Tetraethyl-enepentamine | Not less than 6.0 ASD | Abnormal deposition |
| | Less than 6.0 ASD | Dull |

Example 2

Among the plating baths prepared in example 1, the plating bath containing diethylenetriamine as an aliphatic polyamine was used. In this bath, electrolysis was performed using the Hull cell tester B-55 (YAMAMOTO-MS Co., Ltd.) under the conditions below.

Current: 2 A

Time: 10 min.

Solution temperature: 30° C.

Agitation: Aeration

Anode plate: Nickel plate

Cathode plate: Iron plate (the surface to be plated has a horizontal width of 100 mm)

The entire surface of the resultant zinc-nickel alloy plated coating has bright appearance. FIG. 1 shows the thickness and the nickel co-deposition ratio of the zinc-nickel alloy plated coating. For a referential example, FIG. 1 also shows the thickness of the zinc plated coating (with the entire surface appearing bright) formed through electrolysis under the above conditions using an acid zinc plating bath with the following composition (referential example 1).

Zinc chloride: 50 g/L (25 g/L in terms of zinc)

Potassium chloride: 240 g/L

METASU FZ 500A: 50 ml/L

METASU FZ 500G: 1 ml/L

These agents in the METASU FZ 500 series are the products of YUKEN INDUSTRY CO., LTD.

Figure 2:
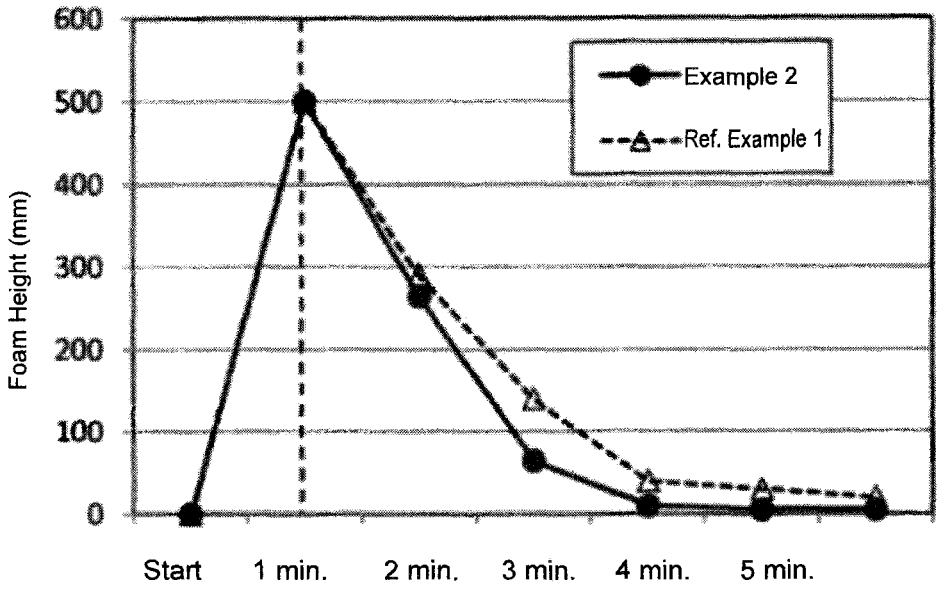
FIG. 2 is a graph showing the test results for the foaming and defoaming properties in example 2.

Under the above electrolysis conditions, the foaming and defoaming properties were tested using the plating bath of example 2 and the plating bath of referential example 1. FIG. 2 shows the test results (the height of the foam produced through electrolysis measured from the solution surface).

The plating bath of example 2 and the plating bath of referential example 1 were diluted, and the concentration of the metal in each of the diluted solutions was measured with ICP (SRS5520, Hitachi High-Tech Science Corporation). Table 2 shows the measurement results.

TABLE 2

| Dilution Ratio | Metal Species | Example 2 | Referential Example 1 |
|---|---|---|---|
| 1:20 | Zn | 0.7 ppm | 1.3 ppm |
| | Ni | 8.0 ppm | 14.0 ppm |
| | Fe | ND | ND |
| 1:100 | Zn | 0.3 ppm | 0.6 ppm |
| | Ni | 0.6 ppm | 1.9 ppm |
| | Fe | ND | ND |

Example 3

Plating baths with the same composition as the plating baths of example 1 were prepared with the varying amount of diethylenetriamine as an aliphatic polyamine contained in each bath from 0 g/L (not added) to 30 g/L as shown in Table 3. Using the plating baths, electrolysis was performed in the same manner as in example 1 using the Hull cell tester B-55-L (YAMAMOTO-MS Co., Ltd.). During the electrolysis, the plating solution was agitated at 900 rpm.

The appearance of the resultant cathode plate was observed, and the coating thickness and the nickel co-deposition ratio were measured. Table 3 shows the observation results of the appearance. Table 4 shows the coating thickness in μm. Table 5 shows the co-deposition ratio of nickel in mass %.

TABLE 3

| Amount of Diethylene-triamine | Appearance of Cathode Plate after Plating | |
|---|---|---|
| | Range | Appearance |
| None | Not less than 3.6 ASD | Abnormal deposition |
| | Less than 3.6 ASD and not less than 0.8 ASD | Bright |
| | Less than 0.8 ASD | Dull |
| 0.1 g/L | Not less than 6.0 ASD | Abnormal deposition |
| | Less than 6.0 ASD and not less than 0.6 ASD | Bright |
| | Less than 0.6 ASD | Dull |

TABLE 3-continued

| Amount of Diethylene-triamine | Appearance of Cathode Plate after Plating | |
|---|---|---|
| | Range | Appearance |
| 0.2 g/L | Not less than 8.4 ASD | Abnormal deposition |
| | Less than 8.4 ASD and not less than 0.17 ASD | Bright |
| | Less than 0.17 ASD | Dull |
| 0.3 g/L | Not less than 10.9 ASD | Abnormal deposition |
| | Less than 10.9 ASD and not less than 0.11 ASD | Bright |
| | Less than 0.11 ASD | Dull |
| 0.4 g/L | Not less than 10.9 ASD | Abnormal deposition |
| | Less than 10.9 ASD and not less than 0.11 ASD | Bright |
| | Less than 0.11 ASD | Dull |
| 0.5 g/L | Not less than 11.7 ASD | Abnormal deposition |
| | Less than 11.7 ASD and not less than 0.11 ASD | Bright |
| | Less than 0.11 ASD | Semi-Bright |
| 2 g/L | Not less than 11.7 ASD | Abnormal deposition |
| | Less than 11.7 ASD | Bright |
| 5 g/L | Not less than 14.1 ASD | Abnormal deposition |
| | Less than 14.1 ASD | Bright |
| 10 g/L | Entire Surface | Bright |
| 15 g/L | Entire Surface | Bright |
| 20 g/L | Not less than 14.1 ASD | Abnormal deposition |
| | Less than 14.1 ASD | Bright |
| 30 g/L | Not less than 14.1 ASD | Abnormal deposition |
| | Less than 14.1 ASD and not less than 2.8 ASD | Dull |
| | Less than 2.8 ASD and not less than 0.03 ASD | Bright |
| | Less than 0.03 ASD | Black |

Example 4

A zinc alloy plating bath with the following composition and the pH of 5.4 was prepared.

Zinc chloride: 70 g/L (35 g/L in terms of zinc)

Nickel chloride hexahydrate: 80 g/L (20 g/L in terms of nickel)

Potassium chloride: 200 g/L

Acetic acid-containing material as a buffer: 40 g/L in terms of acetic acid

Aliphatic polyamine: 2 g/L of diethylenetriamine

Primary brightener: 30 ml/L

Secondary brightener: 2 mUL

In the prepared plating bath, an article, which is a casting of an iron material with the shape of a brake caliper, underwent electrolysis performed under the conditions below:

Current Density: 2 A/dm$^2$

Time: 30 min.

Solution temperature: 30° C.

Agitation: Aeration

Anode material: Zinc and nickel

This produces a zinc alloy plated article having a zinc alloy plated coating properly formed on the casting article. The article was plated with the bright coating on the bottom of its recess for receiving a piston (low current density area), as well as its protrusions (high current density area) without any noticeable abnormal deposition.

The resultant zinc alloy plated article was immersed in a chemical conversion solution having the following composition (at the solution temperature of 25° C.) for 20 seconds.

TABLE 4

| Additive | Current Density (ASD) | | | | | | | | | | | | | | | | | | |
|---|---|---|---|---|---|---|---|---|---|---|---|---|---|---|---|---|---|---|---|
| Amount | 8.4 | 6 | 4.6 | 3.6 | 2.8 | 2.2 | 1.6 | 1.1 | 0.8 | 0.6 | 0.5 | 0.31 | 0.17 | 0.11 | 0.09 | 0.07 | 0.05 | 0.03 | 0.01 |
| 0 g/L | 13.77 | 23.39 | 7.93 | 5.01 | 4.93 | 4.23 | 3.51 | 2.76 | 2.06 | 1.57 | 1.21 | 0.87 | 0.6 | 0.48 | 0.31 | 0.28 | 0.27 | 0.19 | 0.14 |
| 0.1 g/L | 18.98 | 12.73 | 10.08 | 7.93 | 6.39 | 4.9 | 3.8 | 2.83 | 2.06 | 1.53 | 1.17 | 0.86 | 0.64 | 0.41 | 0.28 | 0.25 | 0.24 | 0.16 | 0.12 |
| 0.2 g/L | 20.47 | 13.79 | 10.53 | 8.22 | 6.37 | 4.9 | 3.81 | 2.79 | 2.09 | 1.57 | 1.15 | 0.8 | 0.59 | 0.37 | 0.28 | 0.26 | 0.27 | 0.19 | 0.1 |
| 0.3 g/L | 20.01 | 14.3 | 10.56 | 8.18 | 6.31 | 4.87 | 3.7 | 2.8 | 2.1 | 1.55 | 1.17 | 0.83 | 0.61 | 0.37 | 0.27 | 0.26 | 0.28 | 0.15 | 0.12 |
| 0.4 g/L | 20.76 | 14.46 | 10.59 | 8.32 | 6.36 | 4.87 | 3.67 | 2.82 | 2.11 | 1.57 | 1.17 | 0.88 | 0.67 | 0.39 | 0.28 | 0.27 | 0.25 | 0.17 | 0.12 |
| 0.5 g/L | 21.3 | 14.88 | 11.06 | 8.29 | 6.29 | 4.85 | 3.73 | 2.83 | 2.09 | 1.57 | 1.17 | 0.88 | 0.51 | 0.39 | 0.29 | 0.26 | 0.23 | 0.15 | 0.16 |
| 2 g/L | 19.48 | 13.05 | 8.97 | 6.57 | 4.83 | 3.61 | 2.69 | 2 | 1.47 | 1.16 | 0.85 | 0.61 | 0.42 | 0.27 | 0.19 | 0.16 | 0.17 | 0.12 | 0.11 |
| 5 g/L | 21 | 13.48 | 9.19 | 6.75 | 5.04 | 3.68 | 2.72 | 1.97 | 1.4 | 1.01 | 0.73 | 0.52 | 0.32 | 0.21 | 0.16 | 0.18 | 0.15 | 0.11 | 0.08 |
| 10 g/L | 21.5 | 13.15 | 9.08 | 6.6 | 4.79 | 3.44 | 2.51 | 1.86 | 1.34 | 0.99 | 0.69 | 0.49 | 0.36 | 0.27 | 0.2 | 0.14 | 0.12 | 0.09 | 0.09 |
| 15 g/L | 21.76 | 13.45 | 9.34 | 6.66 | 4.8 | 3.47 | 2.52 | 1.89 | 1.36 | 0.97 | 0.71 | 0.47 | 0.37 | 0.29 | 0.2 | 0.15 | 0.11 | 0.09 | 0.08 |
| 20 g/L | 20.71 | 11.13 | 7.1 | 5 | 3.62 | 2.56 | 1.89 | 1.36 | 0.93 | 0.66 | 0.45 | 0.31 | 0.25 | 0.16 | 0.1 | 0.09 | 0.06 | 0.03 | 0.03 |
| 30 g/L | 18.64 | 10.58 | 7.13 | 5.14 | 3.65 | 2.74 | 1.96 | 1.44 | 1.01 | 0.68 | 0.48 | 0.33 | 0.23 | 0.16 | 0.12 | 0.07 | 0.05 | 0.06 | 0.04 |

TABLE 5

| Additive | Current Density (ASD) | | | | | | | | | | | | | | | | | | |
|---|---|---|---|---|---|---|---|---|---|---|---|---|---|---|---|---|---|---|---|
| Amount | 8.4 | 6 | 4.6 | 3.6 | 2.8 | 2.2 | 1.6 | 1.1 | 0.8 | 0.6 | 0.5 | 0.31 | 0.17 | 0.11 | 0.09 | 0.07 | 0.05 | 0.03 | 0.01 |
| 0 g/L | 14.18 | 16.23 | 7.76 | 2.01 | 2.47 | 2.57 | 3.22 | 3.82 | 2.98 | 3.66 | 4.33 | 3.80 | 4.17 | 5.16 | 5.73 | 3.38 | 3.75 | 12.3 | 15.3 |
| 0.1 g/L | 7.87 | 4.20 | 4.79 | 5.30 | 5.78 | 5.65 | 6.05 | 5.78 | 4.74 | 4.85 | 4.99 | 5.43 | 3.98 | 7.57 | 3.20 | 8.76 | 4.15 | 6.86 | 10.69 |
| 0.2 g/L | 4.60 | 5.57 | 5.68 | 7.33 | 7.88 | 8.40 | 8.80 | 8.33 | 8.00 | 7.60 | 7.82 | 5.84 | 6.08 | 3.31 | 7.24 | 7.09 | 5.96 | 12.87 | 1.62 |
| 0.3 g/L | 5.73 | 5.90 | 7.90 | 8.61 | 9.29 | 9.96 | 9.53 | 9.89 | 9.25 | 9.10 | 9.05 | 9.11 | 8.65 | 6.55 | 9.09 | 13.33 | 11.23 | 2.92 | 4.08 |
| 0.4 g/L | 5.94 | 7.39 | 8.56 | 9.56 | 10.43 | 10.56 | 11.33 | 11.02 | 10.92 | 10.13 | 10.49 | 9.69 | 10.24 | 7.96 | 6.87 | 16.28 | 5.24 | 14.63 | 12.11 |
| 0.5 g/L | 6.91 | 8.28 | 9.54 | 10.34 | 11.44 | 11.71 | 12.24 | 12.07 | 11.94 | 11.62 | 10.96 | 11.68 | 8.82 | 9.39 | 12.88 | 15.00 | 13.40 | 3.67 | 16.09 |
| 2 g/L | 12.00 | 13.85 | 14.77 | 15.41 | 15.89 | 15.70 | 15.38 | 14.69 | 14.59 | 15.15 | 13.27 | 11.95 | 14.33 | 14.88 | 16.54 | 19.42 | 7.92 | 9.54 | 22.57 |
| 5 g/L | 13.46 | 15.00 | 15.66 | 15.88 | 16.02 | 16.48 | 17.54 | 18.01 | 18.55 | 17.52 | 18.91 | 17.54 | 15.54 | 18.92 | 13.52 | 13.27 | 22.12 | 26.99 | 11.85 |
| 10 g/L | 14.77 | 15.77 | 16.46 | 17.07 | 17.85 | 18.75 | 19.11 | 19.65 | 19.85 | 19.95 | 20.67 | 20.90 | 21.41 | 16.84 | 30.63 | 24.27 | 21.94 | 25.85 | 35.92 |
| 15 g/L | 15.24 | 16.38 | 16.56 | 17.67 | 18.54 | 18.79 | 19.54 | 19.89 | 19.14 | 19.86 | 18.63 | 19.32 | 19.78 | 20.20 | 15.76 | 18.31 | 12.54 | 0 | 13.75 |
| 20 g/L | 18.10 | 20.55 | 21.86 | 23.22 | 23.28 | 22.97 | 23.93 | 24.04 | 23.58 | 22.31 | 22.61 | 21.04 | 30.84 | 21.99 | 19.72 | 34.56 | 20.96 | 4.99 | 36.29 |
| 30 g/L | 18.36 | 20.58 | 22.06 | 22.96 | 24.07 | 23.97 | 24.17 | 23.78 | 23.44 | 22.29 | 21.64 | 24.13 | 24.96 | 22.72 | 26.68 | 22.39 | 30.40 | 24.05 | 26.99 |

The article was then washed with water, immersed in a sealer (at the solution temperature of 25° C.) for 20 seconds, washed with water, and dried to complete the brake caliper.

METASU CYN-22A: 30 ml/L

METASU CYN-22B: 70 ml/L

The coating including a conversion coating and a topcoat formed properly on the surface of the completed brake caliper.

Example 5

A zinc alloy plating bath with the following composition and the pH of 5.4 was prepared.

Zinc chloride: 70 g/L (35 g/L in terms of zinc)

Nickel chloride hexahydrate: 80 g/L (20 g/L in terms of nickel)

Potassium chloride: 200 g/L

Acetic acid-containing material as a buffer: 40 g/L in terms of acetic acid

Aliphatic polyamine: 0.5 g/L of diethylenetriamine

Primary brightener: 30 ml/L

Secondary brightener: 0.5 ml/L

The prepared zinc alloy plating solution was used in barrel plating for electrolyzing articles under the conditions below. The articles are M10×55 mm iron bolts with a total weight of 1 kg.

Current density: 1 A/dm$^2$

Time: 30 min.

Solution temperature: 30° C.

Filtration: Continuous filtration

The coating thickness and the nickel co-deposition ratio of the head and the shaft of the bolt plated by barrel plating were measured. Table 6 shows the measurement results. Table 6 also shows the measurement results for referential example 2, in which bolts were plated by similar barrel plating using an alkaline zinc alloy plating bath with the following composition.

Zinc source (in terms of zinc): 10 g/L

Sodium hydroxide: 120 g/L

Nickel source (in terms of nickel): 1.5 g/L

METASU ANT-30M: 60 ml/L

METASU ANT-30SR: 10 ml/L

METASU ANT-30G: 5 ml/L

METASU ANT-30R: 5 ml/L

TABLE 6

| | Measurement Position | Coating Thickness (μm) | Co-Deposition Ratio (mass %) |
|---|---|---|---|
| Example 5 | Head | 12.8 | 14.3 |
| | Shaft | 7 | 14.7 |
| | Average | 9.9 | 14.5 |
| Referential Example 2 | Head | 7.3 | 15.5 |
| | Shaft | 5.2 | 15.8 |
| | Average | 6.3 | 15.7 |

The bolt obtained in example 5 and the bolt obtained in referential example 2 then underwent neutral salt spray testing for 1,200 hours conducted in compliance with JIS Z2371:2000. No red rust was observed.

The invention claimed is:

1. An additive for an acid zinc alloy plating bath, the additive comprising:

an aliphatic polyamine having not more than 12 carbon atoms; and a buffer comprising an acetic acid-containing material that contains acetic acid and/or acetate ions at a concentration of not less than 10 g/L expressed as a content of acetic acid, and a boric acid-containing material that contains boric acid and/or boric acid ions at a concentration of not more than 0.1 g/L expressed as a content of boric acid, and wherein the buffer comprises no ammonia-containing material that contains ammonia and/or ammonium ions.

2. The additive according to claim 1, wherein the aliphatic polyamine comprises at least one compound selected from the group consisting of ethylenediamine, diethylenetriamine, triethylenetetramine, and tetraethylenepentamine.

3. The additive according to claim 1, wherein the aliphatic polyamine comprises none of a carbonyl group and a group including a carbonyl group.

4. An acid zinc alloy plating bath, comprising:

the additive according to claim 1.

5. The acid zinc alloy plating bath according to claim 4, wherein the content of the aliphatic polyamine is in a range of 0.1 to 30 g/L inclusive.

6. The acid zinc alloy plating bath according to claim 4, further comprising:

at least one member selected from the group consisting of primary brighteners and secondary brighteners.

7. A method for producing a zinc alloy plated article including an article and a zinc alloy plated coating formed on a plating surface of the article, the method comprising:

forming the zinc alloy plated coating by electroplating using the acid zinc alloy plating bath according to claim 4.

8. The method according to claim 7, wherein in the electroplating, the article has a current density in a range of 0.1 to 10 A/dm$^2$ inclusive.

9. The method according to claim 7, wherein the article is a secondary processed article.

10. An acid zinc alloy plating bath comprising a buffer, wherein the buffer comprises:

an acetic acid-containing material that contains acetic acid and/or acetate ions at a concentration of not less than 10 g/L expressed as a content of acetic acid; and a boric acid-containing material that contains boric acid and/or boric acid ions at a concentration of not more than 0.1 g/L expressed as a content of boric acid, wherein the buffer comprises no ammonia-containing material that contains ammonia and/or ammonium ions.

* * * * *